US005209670A

United States Patent [19]

Meurer

[11] Patent Number: 5,209,670

[45] Date of Patent: May 11, 1993

[54] POWER DISTRIBUTION DEVICE

[75] Inventor: William H. Meurer, Toluca Lake, Calif.

[73] Assignee: Gunner Lighting Incorporated, a California corporation, North Hollywood, Calif.

[21] Appl. No.: 741,324

[22] Filed: Aug. 7, 1991

[51] Int. Cl.[5] ..... H01R 4/66

[52] U.S. Cl. ..... 439/101; 439/621; 439/654

[58] Field of Search ..... 439/101, 211, 620, 654, 439/686, 621, 622

[56] References Cited

U.S. PATENT DOCUMENTS 2,632,786 3/1953 Hammerly ..... 439/211

4,775,328 10/1988 McCarthy ..... 439/211

*Primary Examiner*—Eugene F. Desmond

*Attorney, Agent, or Firm*—Pretty, Schroeder Brueggemann & Clark

[57] ABSTRACT

A power distribution device is provided for distributing alternating electrical current that is supplied by a power source to a number of electrical connectors, each of which has an electrical ground prong, a neutral prong and a current supply prong which together retain the connector within the device. The device includes a housing, a number of sets of electrical pins or sockets, which are secured within the housing and are adapted to retain the electrical connectors, and a power assembly which is associated with the sockets and with the power source. The power assembly includes a fuse mechanism for providing over-current protection, a first jumping bar that provides an electrical ground connection to the power source and a second jumping bar that provides a neutral connection to the power source.

8 Claims, 2 Drawing Sheets

POWER DISTRIBUTION DEVICE

BACKGROUND OF THE INVENTION

This invention relates generally to power distribution devices and, more particularly, to power distribution devices which distribute alternating electrical current provided by a power source and which are ordinarily used on a temporary basis. A number of applications require the use of temporary, portable power distribution devices which distribute alternating electrical current that is supplied by a power source. The motion picture and television production industries, for example, frequently employ such devices at studios and at a variety of locations where filming is done.

As is conventional, the power source provides alternating electrical current to the distribution device which then distributes the current through multiple outlets of the device. However, a number of such existing devices tend to be ill-suited for distributing alternating electrical current in light of recent changes in electrical codes which require protection of circuitry and appropriate grounding of such devices. Certain of these devices are also cumbersome and do not have their electrical outlets arranged in a manner which best accommodates multiple electrical connectors or plugs. Accordingly, there is a need for a compact and portable device which temporarily distributes alternating electrical current in conformity with electrical code requirements.

SUMMARY OF THE INVENTION

The present invention, which addresses this need, is embodied in a power distribution device which receives alternating electrical current supplied by a power source and distributes such current to a number of electrical connectors, each of which has an electrical ground prong, a neutral prong and a current supply prong which together retain the particular connector within the device. The power source preferably, but not necessarily, includes a first current supply connection and electrical ground and neutral connections. The device includes a housing, a number of sets of electrical pins or sockets, which are secured within the housing and are adapted to retain the electrical connectors, and a power assembly which is associated with the pockets and with the power source. Each set of sockets is adapted to receive and retain a separate electrical connector and includes an electrical ground socket, a neutral socket, and a current supply socket. The power assembly is associated with the power source and with the sockets. It is further adapted to transmit to each current supply socket alternating electrical current supplied by the power source, and to provide an electrical ground connection for each electrical ground socket and an alternating current return connection for each neutral socket.

The power assembly includes a first fuse mechanism for providing over-current protection, a first jumping bar that provides an electrical ground connection to the power source, and a second jumping bar that provides a neutral connection to the power source. The first fuse mechanism is contained within the housing and is connected to the first current supply connection of the power source. The first jumping bar is also contained within the housing and is connected to the electrical ground connection of the power source and to each ground socket, while the second jumping bar is contained within the housing and is connected to the neutral connection of the power source and to each neutral socket.

In more detailed aspects of the invention, the device includes a first cable, which connects the first fuse mechanism to the current supply connection, a second cable which connects the first jumping bar to the electrical ground connection and a third cable that connects the second jumping bar to the neutral connection. Moreover, the first fuse mechanism includes an electrically conductive first fuse bar which retains a plurality of fuses, each of which is secured to a separate one of the current supply sockets. The fuse bar is contained within the housing and is connected to the current supply connection. Additionally, the first fuse mechanism can include a mechanism which is disposed within the fuse bar and retains the plurality of fuses within the fuse bar.

In still more detailed aspects of the invention, the sets of sockets are first through fourth in number, the power source further includes a second current supply connection, and the power assembly has first and second fuse mechanisms which are both contained within the housing. Further, the first fuse mechanism is connected to the first current supply connection of the power source and to the supply sockets associated with the first and second sets of sockets. The second fuse mechanism is connected to the second current supply connection and to the supply sockets associated with the third and fourth sets of sockets. Additionally, the first cable is connected to the first fuse mechanism and is adapted to transmit alternating electrical current to the current supply sockets associated with the first and second sets of sockets. The device then includes a fourth cable which connects the second fuse mechanism to the second current supply connection and is adapted to transmit alternating electrical current to the current supply sockets associated with the third and fourth sets of sockets.

Other features and advantages of the present invention will become more apparent from the following detailed description, taken in conjunction with the accompanying drawings, which illustrate, by way of example the principles of the invention.

DESCRIPTION OF THE PREFERRED EMBODIMENT

Figure 1:
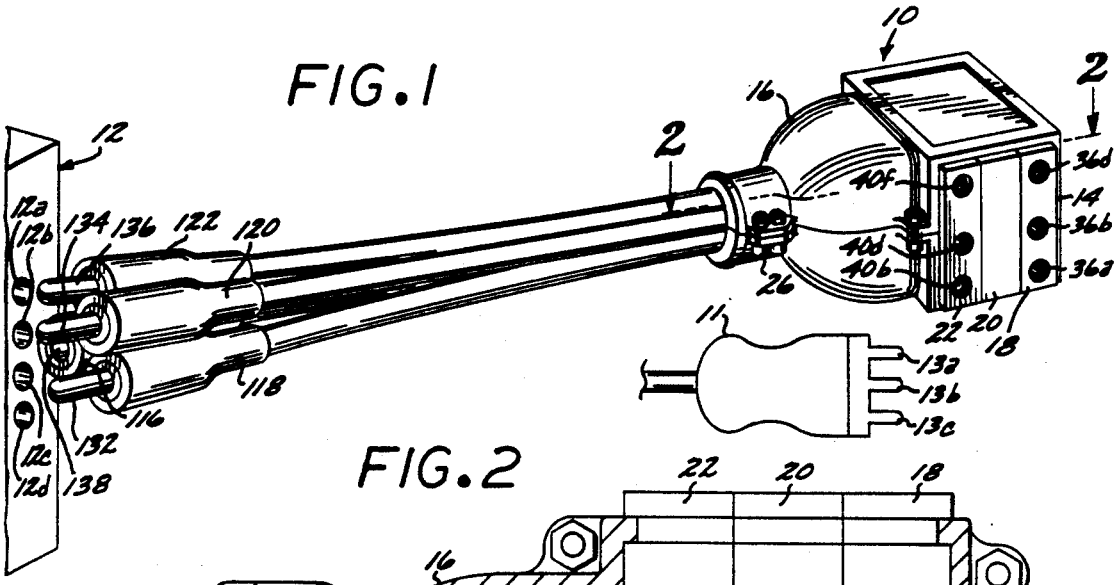
FIG. 1 is a perspective view of the power distribution device and of a suitable electrical connector associated with the device.

With reference now to the exemplary drawings, and particularly to FIG. 1, there is shown a power distribution device 10 to which suitable electrical connector or plugs, such as connector 11, can be attached so that electrical power can be supplied by a suitable power source 12 for a particular use. As is conventional, the plug has three electrically conductive, cylindrical prongs 13*a*, 13*b*, and 13*c*, for transmitting alternating electrical current and establishing an electrical ground connection with the device in a manner discussed below. The prong 13*a* is the electrical current supply prong, while the prongs 13*b* and 13*c* are the neutral or current return and electrical ground prongs respectively. In typical applications, the power source supplies a maximum alternating electrical current of 240 amperes at 120 volts and includes two current supply connections 12*a* and 12*b*, an electrical ground connection 12*c* and a neutral connection 12*d* which are all typically connected to the device by suitable cables.

The device 10 includes a substantially box-shaped housing 14 which is surrounded by a casing 16 and which is formed by juxtaposing three separate electrical connector blocks 18, 20 and 22 with the block 20 being situated between the blocks 18 and 22. The casing is made of a suitably durable material, such as aluminum, and protects the components of the device from being damaged during use and from unnecessary exposure to the environment. It also tends to enhance the safety of the device by protecting individuals from accidental contact with the components of the device that transmit alternating electrical current. In order to facilitate assembly and maintenance of the device, the casing consists of two substantially identical sections that are attached together by suitable fasteners, such as screws 26.

Figure 4:
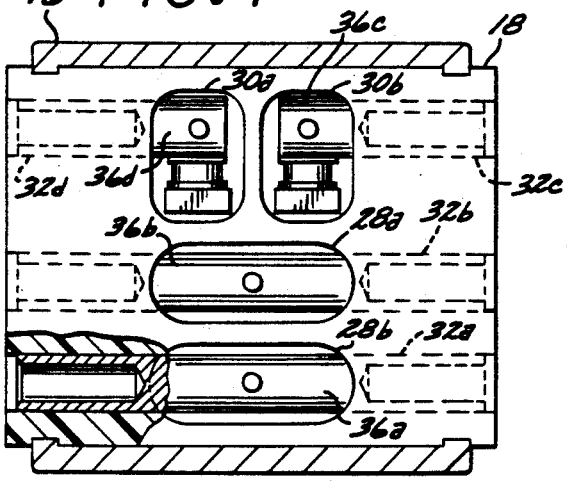
FIG. 4 is a frontal, vertical cross-sectional view of the device, taken substantially along lines 4–4 in FIG. 3.

Each block 18, 20, and 22 is preferably made of an electrically insulated material, such as a phenolic resin. The blocks 18, 20 and 22 each define two separate pairs of ovally shaped cavities 28*a*, 28*b* and 30*a*, 30*b* which extend transversely through the particular block 18, 20 or 22. Each pair of cavities is juxtaposed next to each other and thereby defines a common side wall between each member of the pair (See, FIG. 4). The blocks 18 and 22 also define two separate sets of cylindrical bores 32*a*, 32*b*, 32*c* and 32*d* and 34*a*, 34*b*, 34*c*, 34*d*, 34*e* and 34*f* which extend longitudinally within their respective blocks 18 or 22. (See, FIGS. and 4–7). The purposes of the cavities and cylindrical bores will become more apparent in the discussion which follows.

Figure 5:
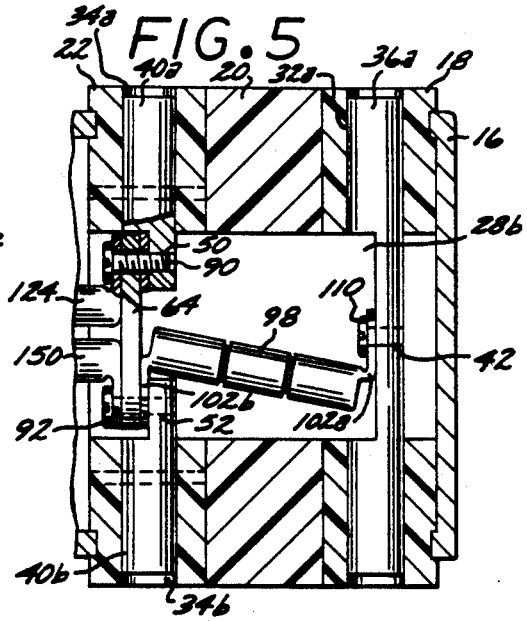
FIG. 5 is a horizontal cross-sectional view of the device, taken substantially along lines 5–5 in FIG. 3.
Figure 6:
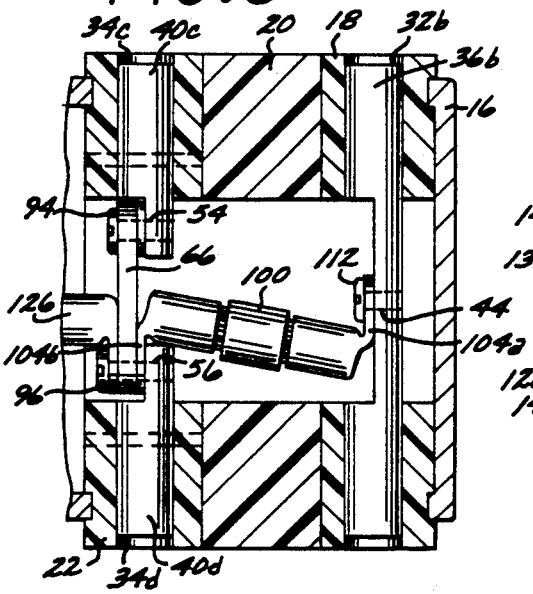
FIG. 6 is another horizontal cross-sectional view of the device, taken substantially along lines 6—6 in FIG. 5.

For the purpose of permitting the proper attachment of electrical connectors or plugs, such as the connector 11, to the device 10 and the appropriate transmission of electrical power through the connectors or plugs, the device also includes two separate sets of electrical connector pins or sockets 36 and 40 which are longitudinally mounted within the respective bores 32*a*, 32*b*, 32*c* and 32*d* and 34*a*, 34*b*, 34*c*, 34*d* and 34*e* of the blocks 18 and 22 respectively. (See, FIGS. 4–7). In particular, the set of pins or sockets 36 associated with the block 18 includes an electrical ground pin 36*a*, a neutral or current return pin 36*b* and current supply pins 36*c* and 36*d*. As depicted in FIGS. 5 and 6, the ground and neutral pins 36*a* and 36*b* are each substantially cylindrical, except for a semi-cylindrical mid-section, and extend longitudinally throughout virtually the entirety of the cylindrical bores 32*a* and 32*b* respectively and through the cavities 28*b* and 28*a* respectively. Centrally disposed within the mid-section of each pin 36*a* and 36*b* is a separate threaded radial bore 42 and 44 respectively. The current supply pins 36*c* and 36*d* are oppositely disposed within the bores 32*c* and 32*d* respectively and are each substantially cylindrical, except for a substantially semi-cylindrical lower portion (See, FIG. 7).

The pins 36*c* and 36*d* extend longitudinally through the bores 32*c* and 32*d* respectively and the cavities 30*a* and 30*b* respectively. They also terminate before contacting the common side-wall formed by the cavities 30*a* and 30*b* so that the pins 36*c* and 36*d* are thereby separated from each other. The semi-cylindrical lower portion of each pin 36*c* and 36*d* further defines a separate threaded radial bore 46 and 48 respectively. Each pin 36*a*, 36*b*, 36*c* and 36*d* defines a cylindrical counterbore (See, FIG. 4) which is of sufficient depth for receiving one of the corresponding prongs 13*a*, 13*b* or 13*c* of the connector 11. It will be observed that the set of pins 36 can accommodate two electrical connectors of the three-pronged type which, when inserted, are oppositely disposed relative to one another. One such connector would fit within the pins 36*a*, 36*b* and 36*c*, while the other connector would fit within pins 36*d*, 36*a* and 36*b* from the opposite side. Thus, for example, prongs 13*b* and 13*c* of the connector 11 would be inserted into the neutral and electrical ground pins 36*b* and 36*a* respectively, while prong 13*a* would be inserted into the current supply pin 36*c*.

As shown in FIGS. 4–7, the set of pins or sockets 40 associated with the block 22 includes a pair of electrical ground pins 40*a* and 40*b*, a pair of neutral pins 40*c* and 40*d*, and a pair of electrical current supply pins 40*e* and 40*f*. Each pin within each pair of pins 40*a*–40*b*, 40*c*–40*d*, and 40*e*–40*f* is substantially cylindrical, except for a substantially semi-cylindrical lower portion, and is oppositely disposed relative to its counterpart member within the pair in a manner similar to pins 36*c* and 36*d*. The pins 40*a*, 40*b*, 40*c*, 40*d*, 40*e* and 40*f* also extend longitudinally through the bores 34*a*, 34*b*, 34*c*, 34*d*, 34*e* and 34*f* respectively. The semi-cylindrical lower portion of each pin further defines a separate threaded radial bore 50, 52, 54, 56, 57 and 58 respectively.

Like the pins 36, the pins 40 each define a cylindrical counterbore which is of sufficient depth for receiving the corresponding prong 13*a*, 13*b*, or 13*c* of the connector 11. The pair of pins 40*e* and 40*f* also extend longitudinally through the cavities 30*b* and 30*a* respectively and terminate before contacting the common side-wall formed by the cavities 30*a* and 30*b*. The semi-cylindrical lower portions of the pins 40*c* and 40*d* extend longitudinally within the cavity 28*a*, while the semi-cylindrical lower portions of the pins 40*a* and 40*b* extend longitudinally within the cavity 28*b*. It will be observed that the set of pins 40 can accommodate two electrical connectors of the three-pronged type which, when inserted, are oppositely disposed relative to each other. Thus, for example, prongs 13*b* and 13*c* of the connector 11 would be inserted into the neutral and electrical ground pins 40*c* and 40*a* respectively, while prong 13*c* would be inserted into the current supply pin 40*e*. The pins 40a, 40c and 40e are also sufficiently spaced apart from each other so that they can receive the prongs 13c, 13b and 13a respectively.

For the purpose of properly transmitting and distributing alternating electrical current from the power source to connectors, such as the connector 11, the device 10 includes a pair of fuse bars 60 and 62 and a pair of jumping bars 64 and 66 which are each made of a suitable electrically conductive material, such as brass or copper.

Figure 2:
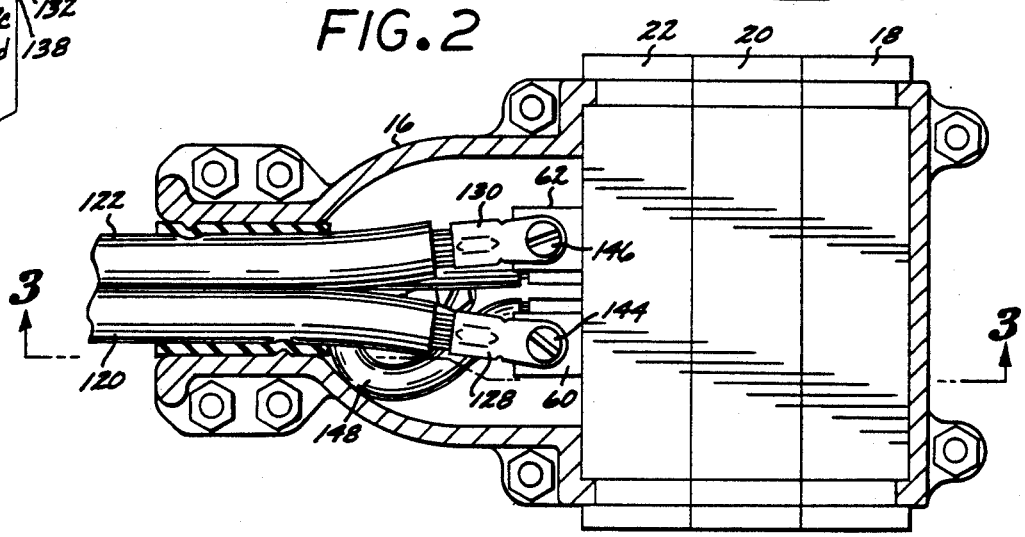
FIG. 2 is an enlarged horizontal cross-sectional view of the device, taken substantially along lines 2—2 in FIG. 1.
Figure 3:
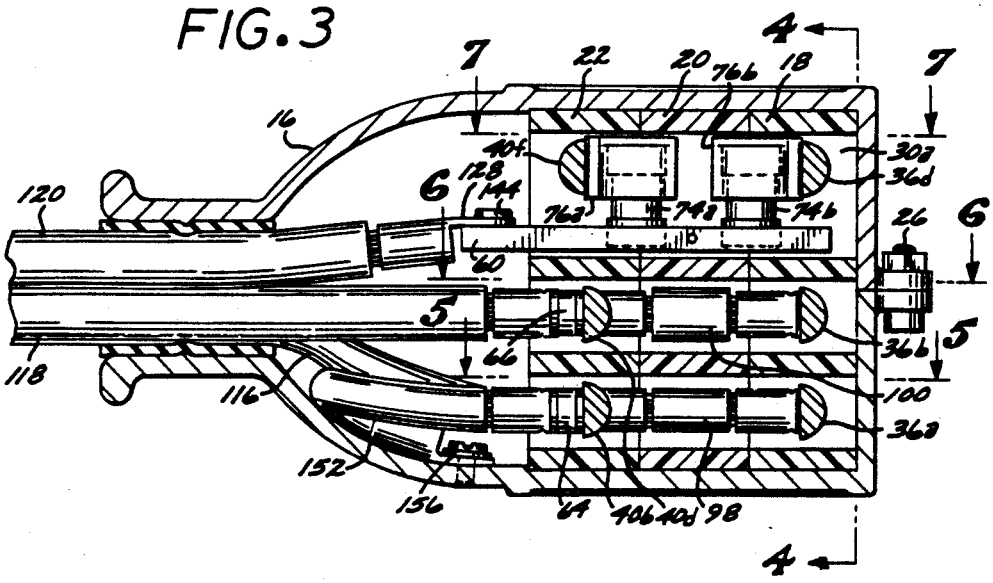
FIG. 3 is an enlarged vertical cross-sectional view of the device, taken substantially along lines 3—3 in FIG. 2.
Figure 7:
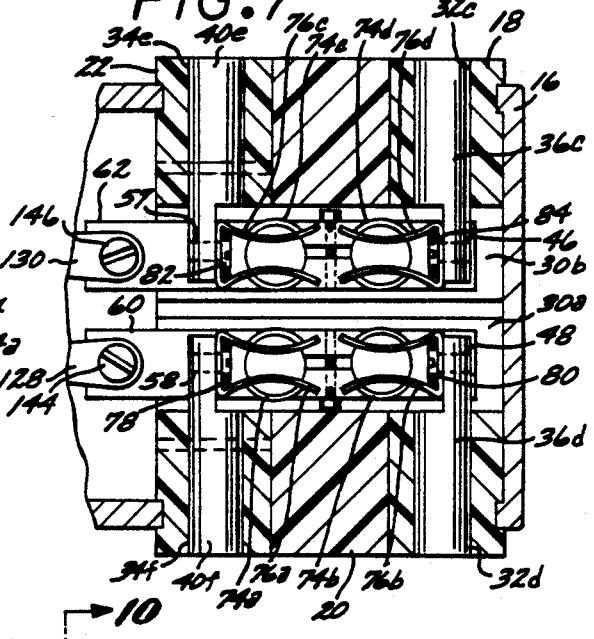
FIG. 7 is another horizontal cross-sectional view of the device, taken substantially along lines 7—7 in FIG. 3.

(See, e.g., FIGS. 2–3 and 5–6). As depicted in FIGS. 3 and 7, the fuse bar 60 extends transversely through the cavity 30a defined by each of the blocks 18, 20 and 22, while the fuse bar 62 extends transversely through the cavity 30b defined by each of the blocks 18, 20 and 22. Each fuse bar 60 and 62 defines two substantially circular openings 68 and 70 and an axial slot 72 that is situated between the openings (See, FIG. 8). The circular openings are appropriately dimensioned so that they each firmly receive a separate fuse 74a, 74b, 74c or 74d (See, FIG. 7). Each fuse provides over-current protection in a well-understood manner and is preferably, but not necessarily, a 60 ampere JJN, class T type fuse.

The fuses 74a, 74b, 74c and 74d are also retained within electrically conductive fuse clips 76a, 76b, 76c and 76d respectively. Fuse clips 76a and 76b are secured by set screws 78 and 80 to the current supply pins 40f and 36d respectively, while fuse clips 76c and 76d are secured by set screws 82 and 84 to current supply pins 40e and 36c respectively. (See, FIG. 7). It will be observed that screws 78, 80, 82 and 84 are received within radial bores 58, 48, 57 and 46 respectively.

Figure 8:
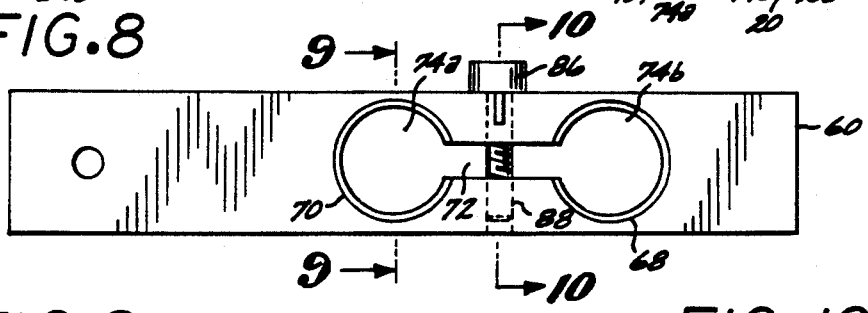
FIG. 8 is an enlarged plan view of a fuse bar of the device with associated fuses and fuse set screw.
Figure 9:
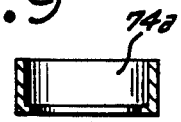
FIG. 9 is a vertical cross-sectional view of fuse bar of FIG. 8, taken substantially along lines 9—9 in FIG. 8.
Figure 10:
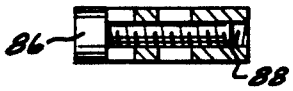
FIG. 10 is another vertical cross-sectional view of a fuse bar of FIG. 8, taken substantially along lines 10—10 in FIG. 8.

As shown in FIGS. 8–10, each fuse bar 60 and 62 also includes a fuse set screw 86 that is contained within a bore 88 located between the circular openings 68 or 70 and extends transversely through the axial slot 72. When the screw 86 is tightened, it furnishes compressive force that facilitates retention of the fuses 74a–74b and 74c–74d within the fuse bars 60 and 62 respectively.

The jumping bar 64 extends longitudinally within the cavity 28b and is secured by set screws 90 and 92 to the semi-cylindrical lower portions of ground pins 40a and 40b respectively. On the other hand, the jumping bar 66 extends longitudinally within the cavity 28a and is secured by set screws 94 and 96 to the semi-cylindrical lower portions of neutral pins 40c and 40d respectively. (Compare FIGS. 5 and 6). Moreover, for the purpose of providing electrically ground and neutral connections to the pins 36a and 36b respectively, the jumping bars 64 and 66 are associated with cables 98 and 100 respectively. In particular, each cable 98 and 100 is preferably made of #2 type wires and has metal connectors 102a and 102b, crimped on each of its ends for securing the cables 98 and 100. The cable 98 extends transversely within each cavity 28b associated with the blocks 18, 20 and 22, while the cable 100 extends transversely within each cavity 28a associated with the blocks 18, 20 and 22. On one of its ends, the cable 98 is secured by its connector 102a to the midsection of the ground pin 36a by a set screw 110 that is threaded within bore 42. The remaining end of the cable 98 is secured by its connector 102b to the jumping bar 64 and the ground pin 40b by the set screw 92. One end of the cable 100 is secured to the mid-section of the neutral pin 36b by a set screw 112 that is threaded within the bore 44 and through the connector 102a. The remaining end of the cable 100 is secured to the jumping bar 66 and the neutral pin 40d by the set screw 96 (See, FIGS. 5–6) which is threaded through the connector 102b.

As depicted in FIGS. 1–3, the device 10 is associated with a series of cables 116, 118, 120 and 122 which together furnish electrical power to the device and provide proper electrical grounding for the device. A separate metal, closed-loop connector 124, 126, 128 and 130 is crimped onto one end of each of the cables 116, 118, 120 and 122 respectively in order to facilitate attachment of the cables 116, 118, 120 and 122 to the device. Substantially cylindrical power connector pins 132, 134, 136 are attached to the other end of cables 118, 120 and 122 for the purpose of connecting the cables 118, 120 and 122 to the power source. A hollow, substantially cylindrical ground pin 138 is connected to the cable 116 in order to provide an electrical ground connection with the power source.

The cable 116 functions as an electrical ground and is attached at its connector 124 to one end of the jumping bar 64 by the screw 90 (See, FIG. 5). The ground pin 138 of the cable 116 is connected to the electrical ground connection 12c of the power source 12. Consequently, the cable 116 provides an electrical ground connection for the ground pins or sockets 40a and 40b. Cable 118 acts as a neutral or electrical current return connection and is secured at its connector 126 to one end of the jumping bar 66 by screw 96 (See, FIG. 6). The power connector pin 132 of the cable 118 is connected to the neutral connection 12d of the power source 12. As a result, the cable 118 supplies an electrical current return or neutral connection for neutral pins or sockets 40c and 40d.

Finally, the cable 120 supplies electrical current to current supply pins or sockets 36d and 40f, while cable 122 supplies electrical current to supply pins or sockets 36c and 40e. As shown in FIGS. 2–3 and 7, the cable 120 is attached at its connector 128 to one end of the fuse bar 60 by set screw 144. Moreover, the power connector pin 134 of the cable 120 is connected to the current supply connection 12a of the power source 12. On the other hand, the cable 122 is secured at its connector 130 to the fuse bar 62 by set screw 146. Further, the power connector pin 136 of the cable 122 is connected to the current supply connection 12a of the power source 12. The cables 120 and 122 each preferably, but not necessarily, each supply a maximum of 120 amperes of alternating current.

As an additional safety precaution, the device 10 also includes an auxiliary ground cable 148 having a metal, closed loop connector 150 and 152 crimped on each of its ends. One end of the cable 148 is secured at its connector 150 to the jumping bar 64 by the screw 92, while the other end is secured at its connector 152 to the casing 16 by screw 156 (See, FIGS. 3 and 5). It will be understood that the cable 148 thus electrically grounds the casing, thereby tending to minimize potential electrical hazard to users of the device 10.

The operation of the device 10 will now be discussed for an instance where the device is to receive its maximum number (i.e., four) of electrical connectors or plugs 11 and the power source is to provide its maximum output of 240 amperes of alternating electrical current at 120 volts since each connector or plug is drawing 60 amperes of current. Preliminarily, the user connects the cables 116, 118, 120 and 122 to the power source 12 as described above and inserts the four electrical connectors into the appropriate pins or sockets 36 or 40 of the device. Thus, a first connector would be received within the pins or sockets 36a, 36b and 36c, a second connector would be received within the pins or sockets 36a, 36b and 36d, a third connector would be received within the pins or sockets 40a, 40c and 40e and the fourth connector within the pins or sockets 40b, 40d and 40f.

Upon activation of the power source 12, cables 120 and 122 then each supply about 120 amperes of alternating electrical current to fuse bars 60 and 62 respectively. As the current supplied by the cable 120 is conducted by the fuse bar 60 and flows through the fuses 74a and 74b, it becomes distributed so that 60 amperes of alternating electrical current flows to each of the current supply pins or sockets 40f and 36d and is drawn by particular connector associated with the pins or sockets 40f and 36d. Likewise, the alternating electrical current supplied by the cable 122 is conducted by the fuse bar 62 and flows through the fuses 74c and 74d. Consequently, the 120 amperes of alternating electrical current supplied by the cable 122 becomes distributed into 60 amperes of current at each of the current supply pins or sockets 40e and 36c respectively. Consequently, each of the four connectors draws its maximum of 60 amperes of alternating electrical current. It will be appreciated that, if each connector were to draw only 30 amperes of alternating electrical current, then cables 120 and 122 would each supply 60 amperes of alternating electrical current.

It will be observed that, when the power source 12 is activated, the cable 118 and the jumping bar 66 together function as electron attractors that induce the flow of alternating electrical current through the current supply pins or sockets 36c, 36d, 40e and 40f in a well-understood manner. Additionally, cable 116 and the jumping bar 64 together provide an electrical ground connection to the power source. In the event that the alternating electrical current supplied to any of the supply pins 36c, 36d, 40e or 40f surges above 60 amperes, the particular fuse 74d, 74b, 74c and 74a associated with the pins 36c, 36d, 40e and 40f terminates the supply of alternating electrical current to the associated connector. It will also be understood that, in the event of such a current surge, or an electrical surge, that the current would return through the ground cable 116.

Although the invention has been described in detail with reference only to the preferred embodiment, those of ordinary skill in the art will appreciate that various modifications can be made without departing from the invention. Accordingly, the invention is defined only by the following claims.

I claim:

1. A power distribution device for receiving alternating electrical current supplied by a power source and for distributing alternating electrical current to a plurality of electrical connectors, each of which has an electrical ground prong, a neutral prong and a current supply prong which together retain the connector within the device, the power source containing an electrical ground connection, a neutral connection and a current supply connection, the device comprising:

a housing;

a plurality of sets of electrical sockets secured within the housing and each adapted to receive and retain a separate one of the electrical connectors, each set of sockets including an electrical ground socket, a neutral socket and a current supply socket; and assembly means, associated with the power source, for transmitting to each current supply socket alternating electrical current supplied by the power source and for providing an electrical ground connection for each electrical ground socket and for providing an alternating current retain connection for each neutral socket, the assembly means including, (a) fuse means, contained within the housing and connected to the current supply connection of the power source and to each supply socket, for providing over-current protection for each supply socket, the fuse means including, (i) an electrically conductive first fuse bar which is contained within the housing and is connected to the current supply connection, (ii) a first plurality of fuses, each of which is secured to a separate one of the current supply sockets and is retained within the fuse bar and (iii) first means, disposed within the fuse bar, for retaining the plurality of fuses within the fuse bar, (b) a first jumping bar, contained within the housing and connected to the electrical ground connection of the power source and to each electrical ground socket, and (c) a second jumping bar, contained within the housing and connected to the neutral connection of the power source and to each electrical neutral socket.

2. A power distribution device according to claim 1, wherein the assembly means further includes:

a first cable which connects the fuse means to the current supply connection and is adapted to transmit alternating electrical current to the current supply sockets, a second cable which connects the first jumping bar to the electrical ground connection; and a third cable which connects the second jumping bar to the neutral connection.

3. A power distribution device according to claim 1, wherein:

the sets of sockets are first through fourth in number; and the fuse means includes, (a) a first electrically conductive fuse bar which is contained within the housing and is connected to the current supply connection, (b) first and second fuses, which are retained within the first fuse bar, the first fuse being secured to the current supply socket associated with the first of the sets of sockets and the second fuse being secured to the current supply socket associated with the second of the set of sockets, (c) first means, disposed within the first fuse bar, for retaining the first and second fuses within the fuse bar, (d) a second electrically conductive fuse bar which is contained within the housing and is connected to the current supply connection, (e) third and fourth fuses which are retained within the second fuse bar, the third fuse being secured to the current supply socket associated with the third of the sets of sockets and the fourth fuse being secured to the current supply socket associated with the fourth of the sets of sockets, and (f) second means, disposed within the fuse bar, for retaining the third and fourth fuses within the fuse bar.

4. A power distribution device according to claim 3, wherein the power source includes a second current supply connection.

5. A power distribution device for receiving alternating electrical current supplied by a power source and for distributing alternating electrical current to a plurality of electrical connectors, each of which has an electrical ground prong, a neutral prong and a current supply prong which together retain the connector within the device, the power source containing an electrical ground connection, a neutral connection and a first current supply connection and a second current supply connection, the device comprising:

a housing;

first through fourth sets of electrical sockets secured within the housing and each adapted to receive and retain a separate one of the electrical connectors, each set of sockets including an electrical ground socket, a neutral socket and a current supply socket; and assembly means, associated with the power source, for transmitting to each current supply socket alternating electrical current supplied by the power source and for providing an electrical ground connection for each electrical ground socket and for providing an alternating current return connection for each neutral socket, the assembly means including, (a) a first jumping bar, contained within the housing and connected to the electrical ground connection of the power source and to each electrical ground socket, (b) a second jumping bar, contained within the housing and connected to the neutral connection of the power source and to each neutral socket, (c) first fuse means, contained within the housing and connected to the first current supply connection of the power source and to the supply sockets associated with the first and second sets of sockets, for providing over-current protection for the supply sockets associated with the first and second sets of sockets, the first fuse means including, (i) an electrically conductive first fuse bar which is contained within the housing and is connected to the first current supply connection, (ii) a first plurality of fuses, each of which is secured to a separate one of the current supply sockets associated with the first and second sets of sockets and is retained within the first fuse bar, and first means, disposed within the first fuse bar, for retaining the first plurality of fuses within the first fuse bar, and (d) second fuse means, contained within the housing and connected to the second current supply connection of the power source and to the supply sockets associated with the third and fourth sets of sockets, for providing over-current protection for the supply sockets associated with the third and fourth sets of sockets, the second fuse means including, (i) an electrically conductive second fuse bar which is contained within the housing and is connected to the second current supply connection, (ii) a second plurality of fuses, each of which is secured to a separate one of the current supply sockets associated with the third and fourth sets of sockets and is retained within the second fuse bar, and (iii) second means, disposed within the second fuse bar, for retaining the second plurality of fuses within the second fuse bar.

6. A power distribution device according to claim 5, wherein the assembly means further includes:

a first cable which connects the first fuse means to the first current supply connection and is adapted to transmit alternating electrical current to the current supply sockets associated with the first and second sets of sockets, a second cable which connects the second fuse means to the second current supply connection and is adapted to transmit alternating electrical current to the current supply sockets associated with the third and fourth sets of sockets;

a third cable which connects the first jumping bar to the electrical ground connection; and a fourth cable which connects the second jumping bar to the neutral connection.

7. A power distribution device according to claim 5, wherein:

the first fuse means includes, (a) a first electrically conductive fuse bar which is contained within the housing and is connected to the first current supply connection, (b) first and second fuses, which are retained within the first fuse bar, the first fuse being secured to the current supply socket associated with the first of the sets of sockets and the second fuse being secured to the current supply socket associated with the second of the set of sockets, (c) first means, disposed within the first fuse bar, for retaining the first and second fuses within the fuse bar, and the second fuse means includes, (a) a second electrically conductive fuse bar which is contained within the housing and is connected to the second current supply connection, (b) third and fourth fuses which are retained within the second fuse bar, the third fuse being secured to the current supply socket associated with the third of the sets of sockets and the fourth fuse being secured to the current supply socket associated with the fourth of the sets of sockets, and (c) second means, disposed within the fuse bar, for retaining the third and fourth fuses within the fuse bar.

8. A power distribution device for receiving alternating electrical current supplied by a power source and for distributing alternating electrical current to a plurality of electrical connectors, each of which has an electrical ground prong, a neutral prong and a current supply prong which together retain the connector within the device, the power source containing an electrical ground connection, a neutral connection and a first current supply connection and a second current supply connection, the device comprising:

a housing;

first through fourth sets of electrical sockets secured within the housing and each adapted to receive and retain a separate one of the electrical connectors, each set of sockets including an electrical ground socket, a neutral socket and a current supply socket; and assembly means, associated with the power source, for transmitting to each current supply socket alternating electrical current supplied by the power source and for providing an electrical ground connection for each electrical ground socket and for providing an alternating current return connection for each neutral socket, the assembly means including, (a) a first jumping bar, contained within the housing and connected to the electrical ground connection of the power source and to each electrical ground socket, (b) a second jumping bar, contained within the housing and connected to the neutral connection of the power source and to each neutral socket, (c) first fuse means, contained within the housing and connected to the first current supply connection of the power source and to the supply sockets associated with the first and second sets of sockets, for providing over-current protection for the supply sockets associated with the first and second sets of sockets, the first fuse means including, (i) an electrically conductive first fuse bar which is contained within the housing and is connected to the first current supply connection, (ii) a first plurality of fuses, each of which is secured to a separate one of the current supply sockets associated with the first and second sets of sockets and is retained within the first fuse bar, and (iii) first means, disposed within the first fuse bar, for retaining the first plurality of fuses within the first fuse bar; and (d) second fuse means, contained within the housing and connected to the second current supply connection of the power source and to the supply sockets associated with the first and fourth sets of sockets, for providing over-current protection for the supply sockets associated with the third and fourth sets of sockets the second fuse means including, (i) an electrically conductive second fuse bar which is contained within the housing and is connected to the second current supply connection, (ii) a second plurality of fuses, each of which is secured to a separate one of the current supply sockets associated with the third and fourth sets of sockets and is retained within the second fuse bar, and (iii) second means, disposed within the second fuse bar, for retaining the second plurality of fuses within the second fuse bar.

* * * * *

UNITED STATES PATENT AND TRADEMARK OFFICE

CERTIFICATE OF CORRECTION

PATENT NO. : 5,209,670

DATED : May 11, 1993

INVENTOR(S) : William H. Meurer

It is certified that error appears in the above-identified patent and that said Letters Patent is hereby corrected as shown below:

In column 8, line 4, change "retain" to --return--.

Signed and Sealed this

Sixteenth Day of May, 1995

*Attest:*

*Attesting Officer*

BRUCE LEHMAN

*Commissioner of Patents and Trademarks*